United States Patent [19]

Edmunds

[11] Patent Number: 4,633,651

[45] Date of Patent: Jan. 6, 1987

[54] APPARATUS AND METHOD FOR EXTRUDING AND PACKAGING PORTIONS OF EXTRUDABLE, FORM RETAINING PRODUCTS

[76] Inventor: Raymond S. Edmunds, 817 Eventide Dr., San Antonio, Tex. 78209

[21] Appl. No.: 705,905

[22] Filed: Feb. 26, 1985

[51] Int. Cl.[4] ..... B65B 63/00

[52] U.S. Cl. ..... 53/435; 53/453; 53/456; 53/475; 53/519; 53/534; 53/559; 426/413; 426/130

[58] Field of Search ..... 53/245, 244, 251, 450, 53/435, 453, 456, 475, 519, 534, 559, 563, 574; 426/130, 410, 413, 414; 225/100

[56] References Cited

U.S. PATENT DOCUMENTS

| | | | |
|---|---|---|---|
| 1,771,734 | 7/1930 | Penley | 53/245 |
| 1,964,084 | 6/1934 | Rundell | 53/245 |
| 2,705,203 | 3/1955 | Heidrich et al. | 426/130 |
| 3,129,546 | 4/1964 | Redmond | 53/519 |
| 3,631,652 | 1/1972 | Redmond | 53/245 |
| 3,675,542 | 7/1972 | Torigoe | 225/100 |
| 3,881,645 | 5/1975 | Kopp | 225/100 |
| 4,338,766 | 7/1982 | Hamilton | 53/574 |
| 4,369,885 | 1/1983 | Redmond | 426/130 |
| 4,449,350 | 5/1984 | Redmond | 53/559 |

*Primary Examiner*—John Sipos
*Assistant Examiner*—Donald R. Studebaker
*Attorney, Agent, or Firm*—Gunn, Lee & Jackson

[57] ABSTRACT

The present invention relates to an apparatus for packaging portions of an extrudable product, such as butter or margarine. The entire apparatus is driven by a single motor with all operations being synchronized therewith. The pliable product is pumped through an extruder, cut into portions, and deposited on one layer of channeled substrate and covered with another layer of substrate, which has an adhesive applied thereto. The substrates are then drawn between compression rollers and cut between the product portions and the product portions automatically fed to trays. As each tray is filled, a rapid advance moves the tray forward a predetermined amount so that the product portions will continue to feed into the next tray. As the trays move forward, they are removed from the entire apparatus for either shipment and/or storage. The adhesive holds the upper substrate to the lower substrate for enclosing the product portion.

18 Claims, 16 Drawing Figures

APPARATUS AND METHOD FOR EXTRUDING AND PACKAGING PORTIONS OF EXTRUDABLE, FORM RETAINING PRODUCTS

BACKGROUND OF THE INVENTION

The present invention relates to an apparatus for extruding pliable substances, such as butter or margarine, and, more particularly, to an extruder that is synchronized with a single drive motor to give individually wrapped product portions which are subsequently deposited into trays, yet each individually wrapped portion being easy to open at the time of usage.

BRIEF DESCRIPTION OF THE PRIOR ART

Prior to the present invention, many different types of apparatuses have been used for wrapping portions of pliable, edible products, such as butter or margarine. Probably one of the more common devices currently being used for packaging a multiplicity of portions into a single tray in U.S. Pat. No. 3,631,652 issued to Redmond, et al. However, the apparatus as shown by Redmond is extremely complex, especially in the manner in which the individual portions are fed into the trays and the manner of removal of the trays. An earlier patent which issued to Redmond is U.S. Pat. No. 3,129,546, which shows in FIG. 1 thereof a "finish pat" that is commonly used in restaurants today.

Many different types of devices have been developed in the past for wrapping individual portions of pliable products, such as butter or margarine. The idea is to have the individual portions individually wrapped yet easy to unwrap for ease of use at the dining table, especially in restaurants and cafes. The apparatus used to package the product portions has to be very reliable because of the large quantities being packaged.

The previous machines that were used, including the ones by Redmond, were extremely complex and expensive. Further, the end product was not packaged in a manner preferred because the end product would either be (1) too exposed to the atmosphere and contaminants, or (2) too difficult to open at the dining table. The wrapping of the product portion must be a balancing between protecting the product against contamination and, at the same time, ease of opening and use.

Another Redmond patent, U.S. Pat. No. 4,369,885, shows individually wrapped and sealed portions; however, the apparatus used in forming the sealed portions is extremely complex and expensive. Further, the sealed portions have a cohesive coating over the entire surface, which is more coating than is desirable. While the cohesive coating may be edible, the general public prefers the use of as little coatinge as possible and further prefers that the cohesive coating not come in contact with the product portion.

SUMMARY OF THE INVENTION

It is an object of the present invention to provide an apparatus for extruding pliable products and individually wrapping product portions.

It is another object of the present invention to extrude pliable products, such as butter or margarine, and to individually wrap the product portions and deposit the product portions in trays for subsequent distribution or sale.

It is yet another object of the present invention to provide an extruding apparatus synchronized from a common motor for extruding a pliable product, such as margarine, onto one layer of material, covering the product portion which another layer of material, separating the individual portions and layers of material, and depositing each individual package containing a product portion into a tray, which trays are then removed upon filling to another location for either package, storage or shipment.

The present apparatus receives the pliable product, such as margarine, from a reservior through a conduit to a pump, which pump is driven by a motor. All working components of the apparatus are synchronized to the speed of the motor. From the pump, the pliable product is pumped through an extruder, cut into individual portions, and deposited on a first layer of substrate, which has been prefolded to form a channel of the same depth as the thickness of the product. The product is covered by a second layer of substrate, which has an edible adhesive applied to the outer edges thereof. Subsequently the substrate is cut between the individual portions, with the portions being separated and deposited into trays, which trays are advancing to receive each separate product portion. As the tray is filled, the tray will "fast advance" through a cam mechanism so that the next product portion received will be received into the next tray. The trays further advance after filling to be removed from the advancing apparatus. Guides holding the trays into position as the trays advance for filling.

A control mechanism synchronizes everything with the motor for proper operation of the system. For example, a one direction clutch is controlled so that a fast advance is provided between trays when one tray has been filled and is necessary to advance the system to a second tray before the next product portion is ready to feed into the tray. The timing of the fast advance must be synchronized with the operation of the motor.

BRIEF DESCRIPTION OF THE DRAWINGS

FIG. 56 is a cross-sectional view of FIG. 5 along section lines 6—6.

BRIEF DESCRIPTION OF THE PREFERRED EMBODIMENT

Figure 1:
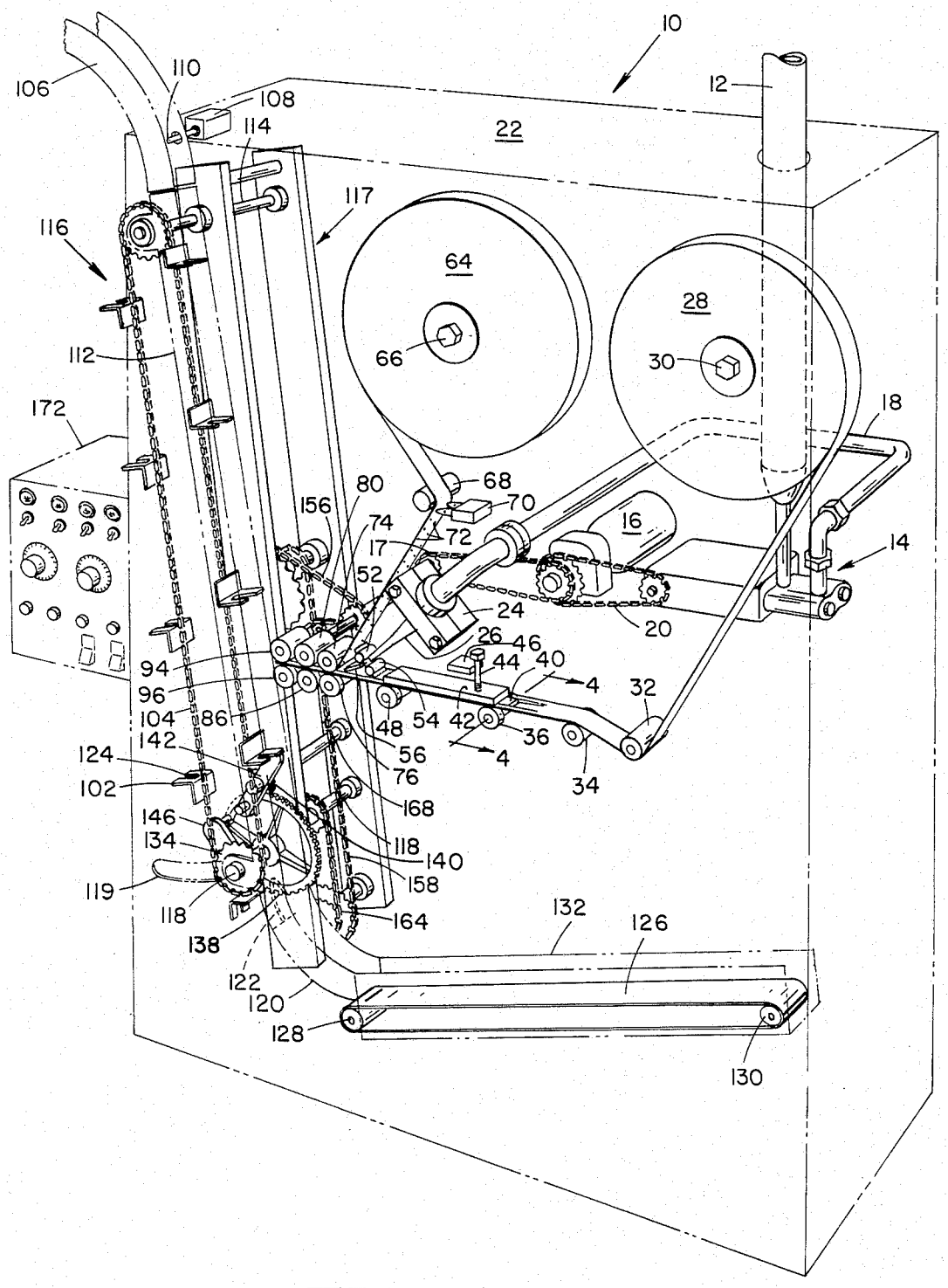
FIG. 1 is an illustrative perspective view of the subject invention with some parts in reference lines.

Referring to FIG. 1 of the drawings, there is illustrated in a perspective view the product portion extruder and packaging apparatus 10 which illustrates the present invention. A pliable product to be extruded, such as butter or margarine, is received through stainless steel conduit 12 from a source (not shown) of the pliable product. Typically the pressure of the pliable product as received in stainless steel conduit 12 could be between 150–250 psi.

A pump 14 is driven by a central drive motor 16 to pump the pliable product into extruder conduit 18. The pump 14 is driven by pump chain 20 from central drive motor 16. Also the pump 14 steps down the pressure from conduit 12 to approximately 100 psi in extruder conduit 18. The central drive motor 16 also drives all other moving parts with drive chain 17 as will be subsequently described.

The discharge end of extruder conduit 18 is attached to the housing 22 by means of a support block 24. Also connected in the support block 24 and connected to extruder conduit 18 is extruder 26. The produce being extruded through extruder 26 is normally about 1.188 inches wide and either 0.20 inches or 0.25 inches thick.

Figure 3A:
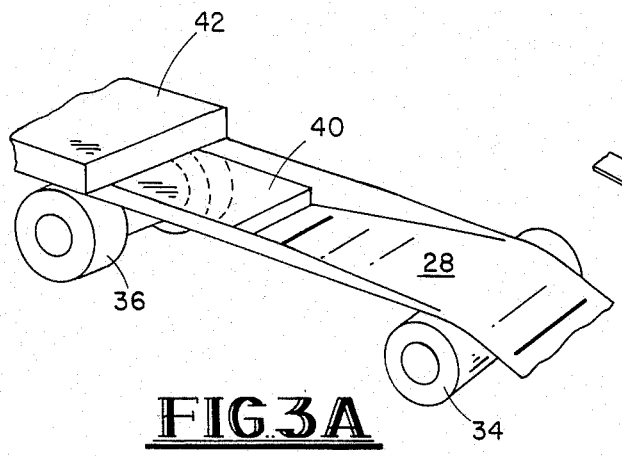
FIGS. 3A, 3B, 3C, 3D, and 3E are sequential perspective views illustrating feeding of substrate and product prior to depositing in trays.
Figure 4:
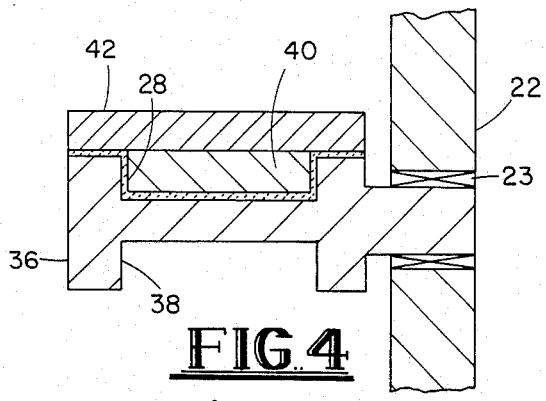
FIG. 4 is a partial cross-sectional view of FIG. 1 along section lines 4—4.

Simultaneously with the extrudable product being extruded through extruder 26, a bottom substrate 28 is mounted on air chuck shaft 30 for dispensing by the product portion extruder apparatus 10. The bottom substrate 28 feeds by idler rollers 32 and 34 to a substrate creasing roller 36. Referring to FIGS. 4 and 3A in combination with FIG. 1, a better understanding of the substrate creasing roller 36 can be obtained. The substrate creasing roller 36 is pivotally mounted in housing 22 on bearing 23. The substrate creasing roller 36 has a channel 38 that is slightly wider than the desired width of the product, the width of the product currently being approximately 1.188 inches.

Floating inside of the channel 38 of the substrate creasing roller 36 to crease the bottom substrate 28 is a floating bar 40 held into position by a weight and stop bar 42. A bolt 44 threadably connects weight and stop bar 42 to floating bar 40, which bolt 44 abuts stop 46 as can be seen in FIG. 1. This allows the bottom substrate 28 to be fed over the idler roller 34 onto the substrate creasing roller 36. The floating bar 40 forces the substrate into the channel 38 with the combination of the floating bar 40, weight and stop bar 42, and the channel 38 of the substrate creasing roller 36 forming the substrate into a channel for receiving the extruded product into the channel 58. It should be realized that floating bar 40 and weight and stop bar 42 are floating on top of the substrate 28 and may be removed for cleaning or any other reason desired. To insure that the bottom substrate 28 is sufficiently creased, a second substrate creasing roller 48 is also provided.

Figure 3B:
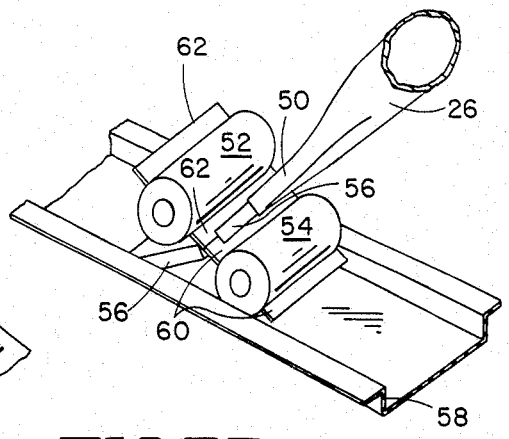

As the bottom substrate 28 advances, product 50 inside of extruder 26 is simultaneously being fed through product cutters 52 and 54 to deposit individual product portions 56 into the channel 58 formed in the bottom substrate 28. This can be seen by referring to FIG. 3B in combination with FIG. 1. Each of the cutters 52 and 54 are timed and synchronized with the central drive motor 16 so that the product cutter blades 60 and 62 simultaneously come together as illustrated in FIG. 3B to cut the product 50 into product portions 56 prior to depositing into channel 58 of bottom substrate 28.

It should be realized that the product portions 56 are running at a different lineal speed than the bottom substrate 28. Because of the difference in the lineal speed of the product portions 56 and bottom substrate 28, there will be a spacing of approximately one inch between the trailing edge and the forward edge of each product portions 56 on the bottom substrate 28.

Figure 3C:
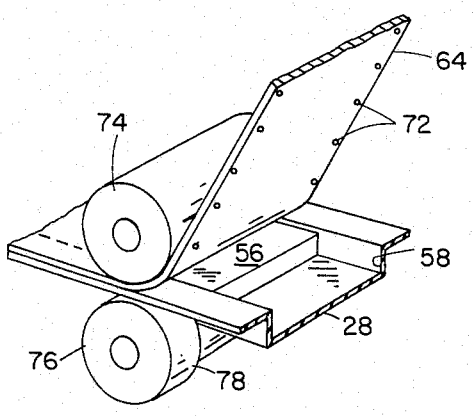

Simultaneously, upper substrate 64 is being fed from air chuck shaft 66 through idler roller 68 past a hot melt adhesive applicator 70. The hot melt adhesive applicator 70 will apply an edible-type adhesive 72 to the outer edges of upper substrate 64. The adhesive 72 can be applied continuously, intermittently, or in dots as is illustrated in FIG. 3c. Typical hot melt adhesive applicators are manufactured by Meltex Corporation located at 404 Dividend Drive, Peachtree City, GA. 30269.

Referring to FIG. 3C in combination with FIG. 1, draw rollers 74 and 76 press against the outer edges of bottom substrate 28 and upper substrate 64 to press the adhesive 72 therebetween. The lower draw roller 76 is fixed in a rotatable position and has a channel 78 therein to receive the channel 58 of the bottom substrate 28 therein along with the product portions 56. The draw rollers 74 and 76 are positively driven with the upper draw roller 74 being movable up and down and maintained in position by a compression device (not shown), which will maintain suitable compression between draw rollers 74 and 76. The amount of compression will depend upon the product being extruded, the types of substrate being used, temperature of the product, as well as a number of other variables, which may be controlled by a microprocessor.

Figure 3D:
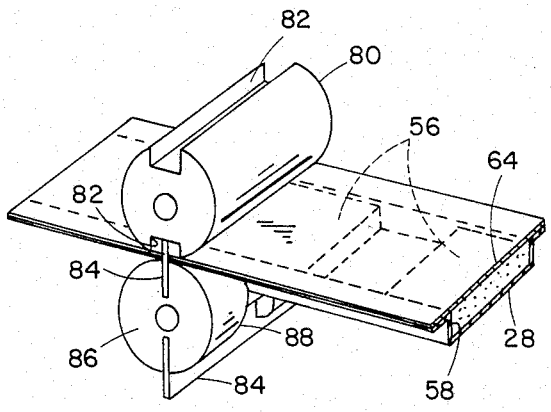
Figure 5:
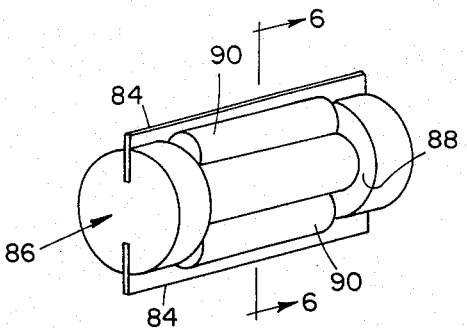
FIG. 5 is a perpsective view of a cutter roller used in FIG. 1.
Figure 6:
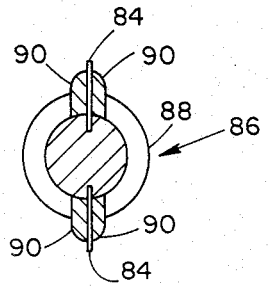

Referring to FIG. 1 in combination with FIGS. 3D, 5 and 6, the operation for cutting upper and lower substrate 64 and 28, respectively, and creasing the lower substrate 28 will be explained. An upper roller 80 has grooves 82 cut therein for receiving serrated blades 84 therein as the serrated blades 84 cut the bottom and upper substrate 28 and 64, respectively. The serrated blades 84 are mounted in cutter roller 86, which has a channel 88 formed therein for allowing the product portions 56 to feed therethrough. Particularly not that the speed of the product portions 56 is timed so that there is a space between each product portion 56 as is illustrated in FIG. 3D. Also the upper roller 80 and the cutter roller 86 are timed and synchronized to cut between the product portions 56, again as is illustrated in FIG. 3D.

Figure 10:
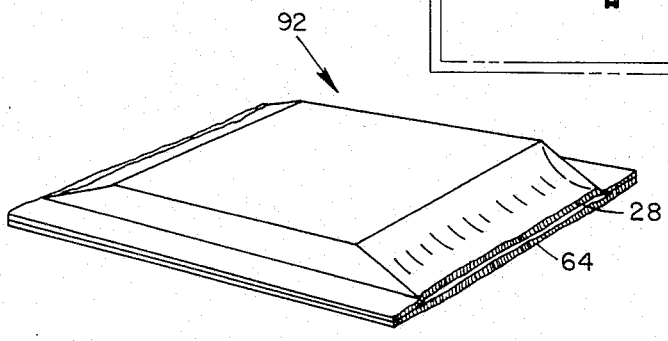
FIG. 10 is a perspective view of the wrapped product portion.

While the sides of the lower substrate 28 have been formed to give channel 58 and have subsequently been glued to upper substrate 64 with adhesive 74, there remains the open space between portions 56 after cutting if no tucking is performed at each end thereof. Therefore, located immediately adjacent and on each side of the serrated blades 84 are anvils 90 that tuck or compress the ends of bottom substrate 28 simultaneous with the cutting by the serrated blades 84. An example of the wrapped produce portion 92 is illustrated in FIG. 10, though inverted so that the bottom substrate 28 is now on top and the upper substrate 64 is now on bottom. While in this particular application, applicant does not plan to apply the adhesive 72 to the tucked portions of bottom substrate 28, the hot melt adhesive applicator 70 could be timed to apply small amounts of adhesive to the tucked portion of bottom substrate 28 for attachment to upper substrate 64.

Figure 3E:
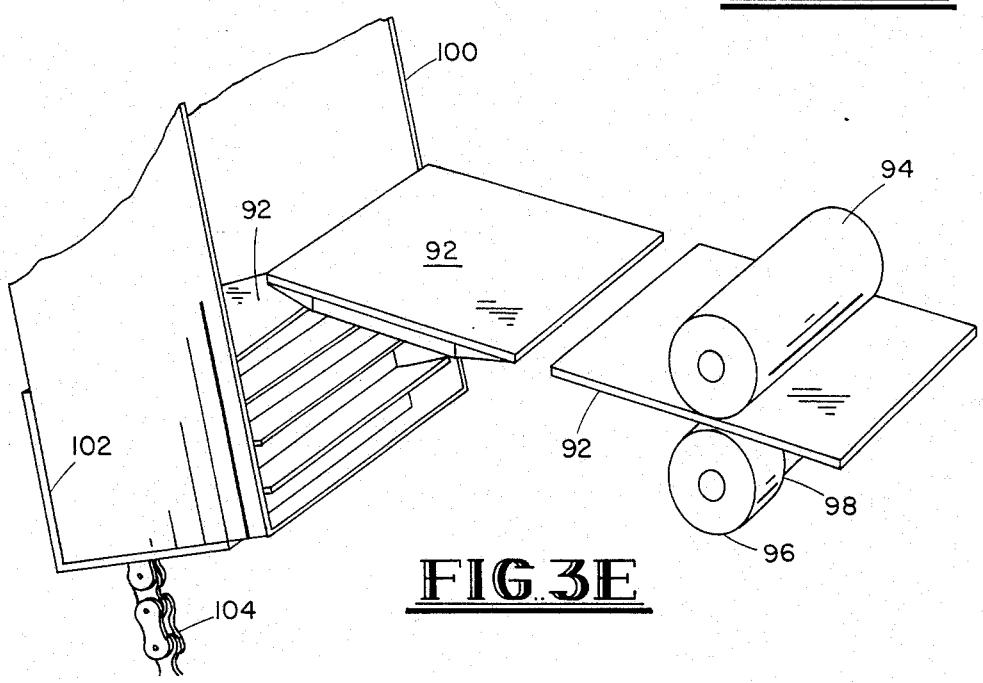

Referring back to FIG. 1 in combination with FIG. 3E, tension rollers 94 and 96 have a faster peripheral surface speed than the draw rollers 74 and 76 and therefore separate the wrapped product portions 92. Again the lower tension roller 96 has a channel 98 therein so that the product portion 56 can feed therethrough. Again tension roller 96 is pivotally fixed an tension roller 94 is movable with a compression device (not shown) for maintaining a sufficient amount of compression between tension roller 94 and tension roller 96. From tension rollers 94 and 96, the wrapped product portions 92 are discharged into a tray 100 that is carried by flights 102 carried on tray chain 104 as will be subsequently described.

Figure 2:
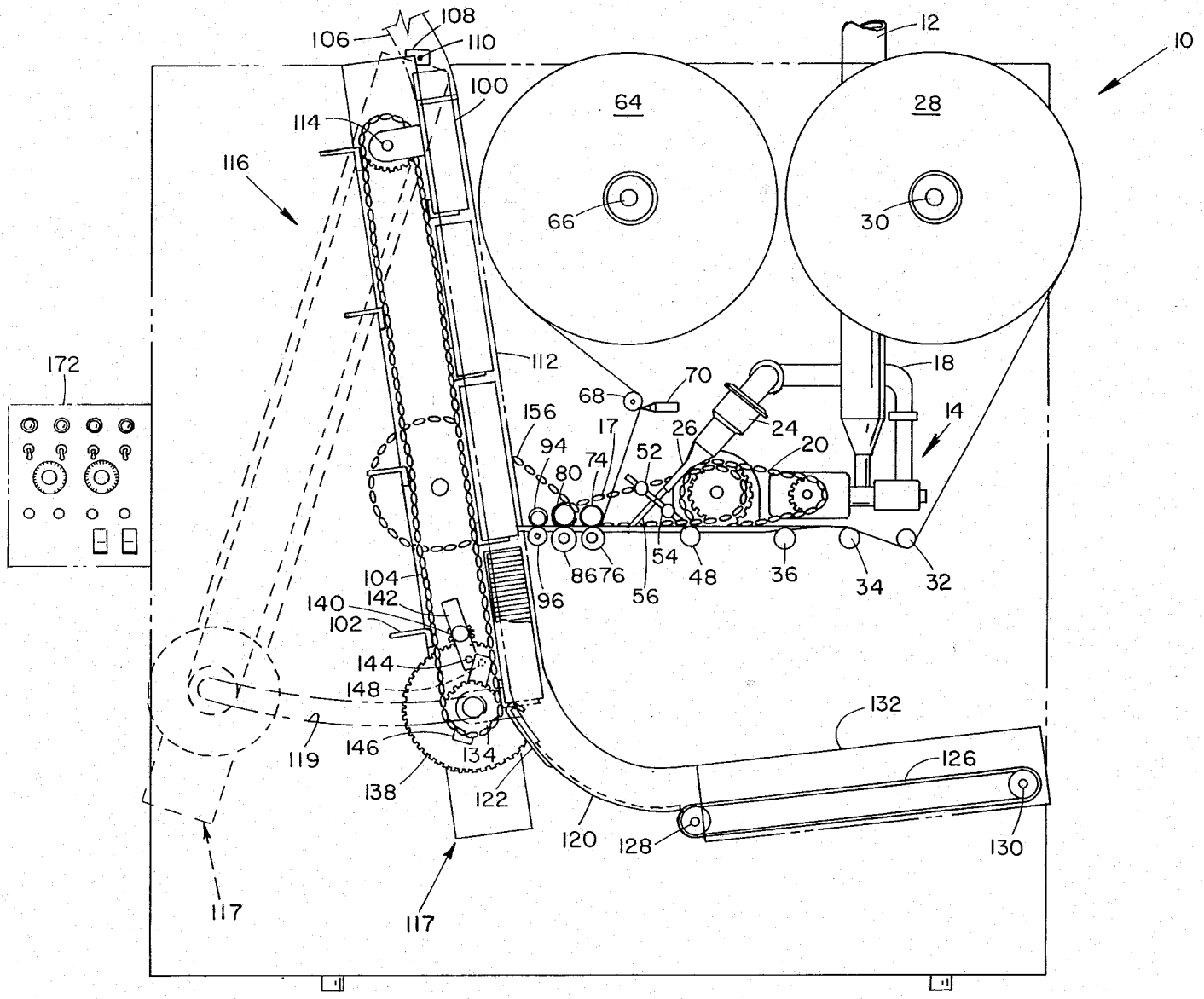
FIG. 2 is a front elevational view of FIG. 1.

Referring now to FIGS. 1, 2, and 3 in combination, a delivery chute 106 delivers trays 100 to the product portion extruder and packaging apparatus 10. Some type of timing mechanism, such as a solenoid 108 that operates a stop bar 110, maintains a tray 100 in a position ready to be delivered to the next flight 102 as mounted on tray chain 104. The lower end of the deliver chute 106 is terminating adjacent an upper end of pivotal guide chute 112.

The pivotal guide chute 112 is shown in reference lines so that the remaining portions of the product portion extruder and packaging apparatus 10 can be seen in further detail. The pivotal guide chute 112 is mounted on collator pivot bar 114 of the collator assembly represented generally by reference numeral 116. The opposite end of the pivotal guide chute 112 is mounted on movable pivot bar 118. It should be realized that the physical attachment of the pivotal guide chute 112 to collator pivot bar 114 and movable pivot bar 118 are by internal bearings (not shown) so that the pivotal guide chute 112 rides on bearing surfaces and is simply supported by the respective bars 114 and 118.

Figure 9:
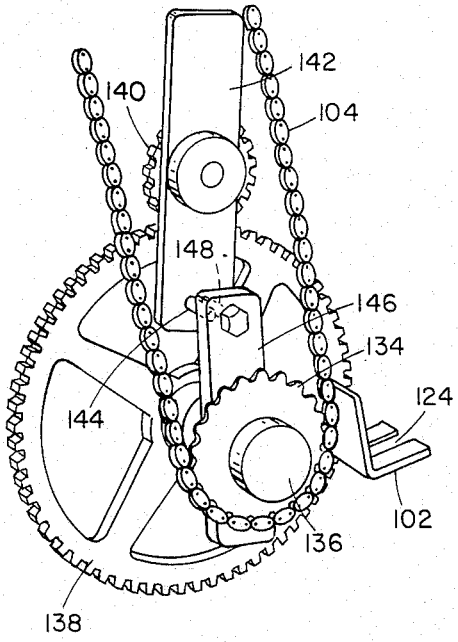
FIG. 9 is an enlarged perspective view illustrating the mechanism for rapid advance of the collator assembly.

A lower part 120 of the pivotal guide chute 112 has a finger member 122 extending through slots 124 in flights 102 for removing the trays 100 from the flights (see FIG. 9). Because the finger member 122 removes the trays 100 from the flights 102, the curve as formed in the lower part 120 redirects the trays to a delivery conveyor 126. The delivery conveyor 126 is operated by the motor 16 and runs on conveyor rollers 128 and 130. The lowermost part of the pivotal guide chute 112 is received inside of fixed conveyor chute 132. Fixed conveyor chute 132, while extending around delivery conveyor 126, is physically attached to the housing 22.

For illustration purposes, the delivery conveyor 126 is simply illustrated as going to the edge of the housing 22; however, the delivery conveyor 126 could be extended to deliver the trays to any particular location desired by the user.

Figure 8A:
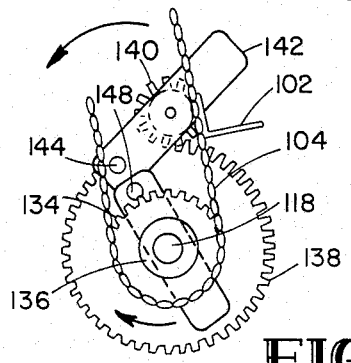
FIGS. 8A, 8B, and 8C are sequential views illustrating the rapid advance of the collator assembly when changing from one tray to another.

It should be realized that the tray chain 104 moves at a speed timed to receive each of the wrapped product portions 92 being fed therein. However, upon one tray 100 being filled and another tray being moved into the ready position for filling, some type of fast advance for the tray chain 104 is necessary. On the lower end of collator assembly 116 is a positive driven shaft previously referred to as movable pilot bar 118. Referring to the perspective view of FIG. 9 and the sequential views of FIGS. 8A, 8B, and 8C in combination with FIG. 1, the fast advance for the trays 100 will be explained. The positive driven shaft (or movable pivot bar) 118 turns tray chain drive sprocket 134. Contained internal in tray chain drive sprocket is a one directional overriding brake clutch (not shown) within a brake clutch housing 136.

Figure 8B:
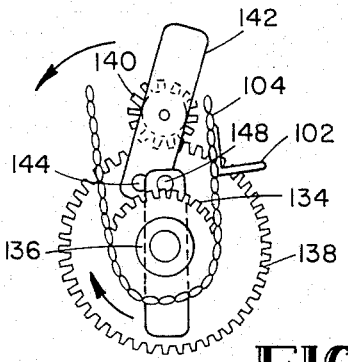
Figure 8C:
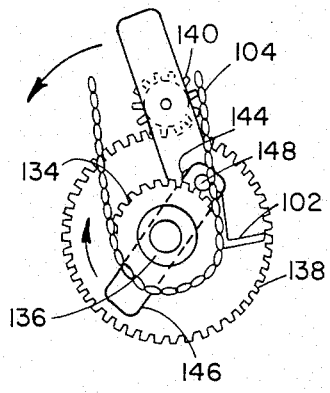

Mounted on positive drive shaft 118 and driven thereby is fixed gear 138. Fixed gear 138 drives pinion gear 140. Carried with the pinion gear 140 immediately adjacent thereto is lever 142 having a cam follower 144 on one end thereof. Attached to the tray drive chain sprocket 134 is sprocket lever 146 and sprocket cam follower 148 on one end thereof. The number of teeth in the fixed gear 138 and the pinion gear 140 is sized so that each time the sprocket cam follower 148 moves into position as illustrated by FIG. 8B, cam follower 144 will strike the sprocket cam follower 148. Because the sprocket lever 146 is attached to the tray chain drive sprocket 134 that has a one directional brake clutch contained in brake clutch housing 136, the cam follower 144 will push the sprocket cam follower 148 forward much more quickly than normal as illustrated in the camming action of sequential views of FIGS. 8B and 8C. The timing of the striking of the cam followers 144 and 148 is such that as the tray 100 is filled with wrapped product portions 92, the cam followers 144 and 148 will strike thereby rapidly advancing the tray chain 104 and trays 100 as mounted thereon so that the next tray 100 will be moved into position for filling before the next wrapped product portion 92 is discharged into the tray 100.

Referring to FIG. 1, a frame 117 for the collator assembly 116 is pivotally mounted at an upper end thereof on collator pin bar 114. The lower end of the frame 117 has movable pivot bar (also sometimes called "positive driven shaft") 118 extending therethrough. Also the movable pivot bar 118 extends through arcuate slot 119 in the housing 22 to tray chain drive sprocket 134. The entire collator assembly 116 is moved forward as shown in FIG. 1 when in use; however, the collator assembly 116 may be pivoted back as shown in broken lines in FIG. 2 for cleaning. The forwardmost position of the collator assembly 116 may be adjusted by set screws (not shown), or held in a forwardmost position by a pneumatic device (not shown).

Figure 7:
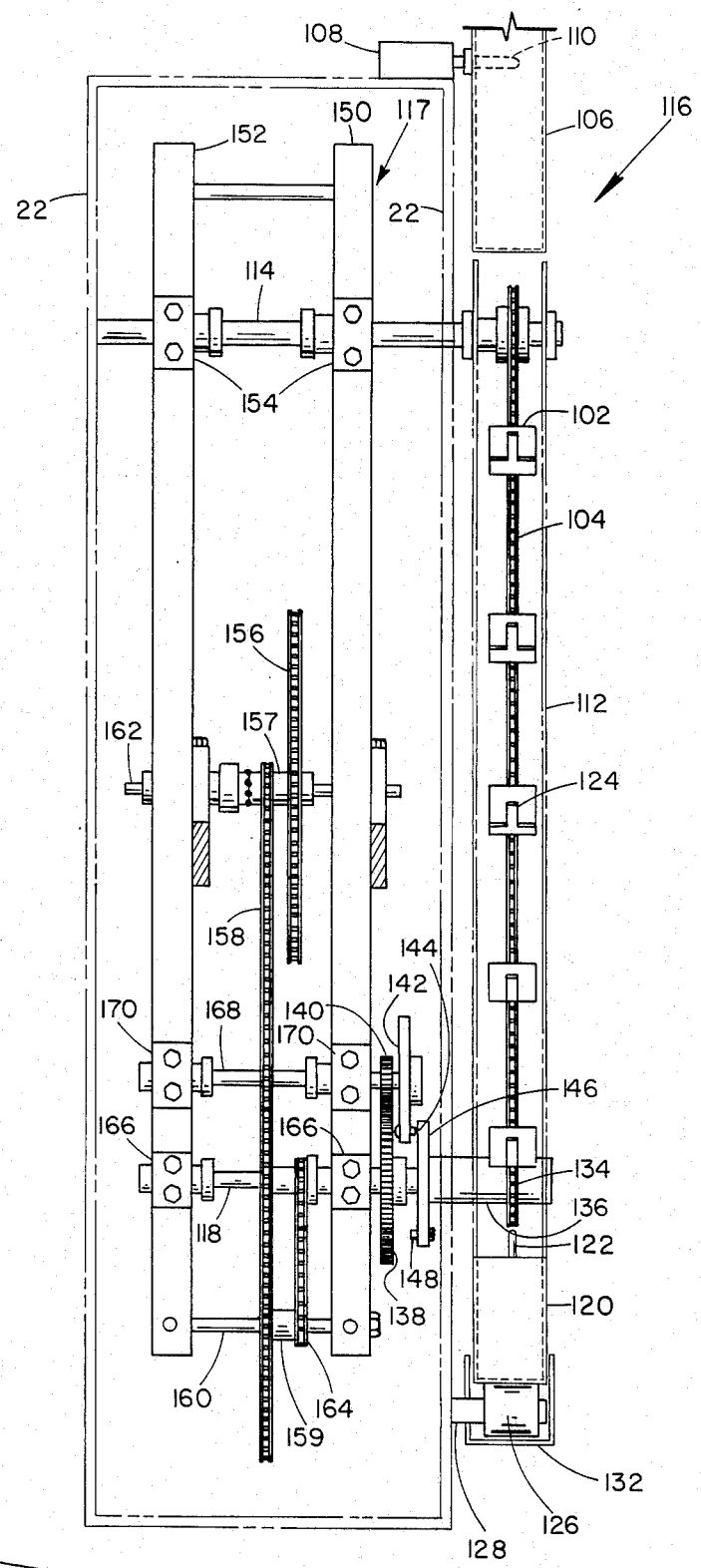
FIG. 7 is a pictorial rear elevational view illustrating drive components for the trays and tray advancement.

Referring to FIG. 7, a pictorial rear elevational view illustrates the drive functions of the collator assembly 116. Support bars 150 and 152 of frame 117 are mounted on collator pivot bar 114 by bearing surfaces 154. Drive chain 156 is connected to the motor 16 via drive chain 17 (see FIG. 1) for providing the initial drive of the collator assembly 116. A tension sprocket (not shown) may be utilized to maintain tension on drive chain 156. Drive chain 156 in turn drives secondary drive chain 158 which connects to an idler sprocket mounted on stationary shaft 160 mounted in support bars 150 and 152. The sprockets 157 for drive chain 156 and secondary drive chain 158 as mounted on drive shaft 162 are tied together so they rotate simultaneously. Likewise on stationary shaft 160, the sprockets 159 for secondary drive chain 158 and drive chain 164 are tied together. The drive chain 164 turns positive driven shaft 118. As positive driven shaft 118 turns, sprocket 134 and fixed gear 138 also turn. Positive driven shaft 118 is mounted in frame 117 with bearing surfaces 166 in support bars 150 and 152.

The fixed gear 138 on positive driven shaft 118 in turn moves the pinion gear 140 as mounted on pinion gear shaft 168. As pinion gear shaft 168 turns on bearing surfaces 170, lever 142, which is attached to pinion gear shaft 168, also turns. The turning of lever 142 moves cam follower 144 so that cam follower 144 periodically strike sprocket cam follower 148 mounted on sprocket lever 146 thereby causing the sprocket lever 146 and tray chain drive sprocket 134 to fast advance. Otherwise sprocket lever 146 and cam follower 148 will rotate at the same speed as tray chain drive sprocket 134. The clutch (not shown) in brake clutch housing 136 allows sprocket lever 146 to fast advance. The fast advance also causes tray chain 104 and trays 100 to fast advance.

FIG. 2 is simply a front elevational view of FIG. 1 with the same numerals being applied thereto. The pivotal position of collator assembly 116 is illustrated in broken lines. FIG. 2 will not be reviewed in detail.

All of the operations for the product portion extruder and packaging apparatus 10 are controlled in a control box 172. While the operation of the control box 172 is not explained in detail, the control box would control such things as the speed of the motor 16, compression to be applied to the rollers, temperature of the product cutters 52 and 54, application of the hot melt adhesive, and the tension on bottom substrate 28 and upper substrate 64, just to give a few examples. Also the control box 172 would have a jogging control so that upon pressing a button, the product portion extruder and packaging apparatus 10 would advance with only a few wrapped product portions 92 being completed.

The particular type pump 14 being envisioned for use in the product portion extruder and packaging apparatus 10 is a CAT 290 Piston Pump. The hot melt adhesive applicator 70 may be Meltex Model GR11 with the applicator being an EP45-1/70 Coating Head, or equivalent structure. Central drive motor 16 may be of any particular type, such as either a DC motor or adjustable AC speed motor. Applicant has found a Baldor motor to be particularly suitable for use.

In the present apparatus 10, it is envisioned that approximately 1,600 wrapped product portions 92 will be produced per minute with the speed of the substrates being approximately 314 feet per minute. The top substrate 64 would be approximately 2 inches wide and the bottom substrate 28 being approximately 2.5 inches wide. It is presently envisioned that the product portions 56 would be approximatey 1.188 inches wide and 1.357 inches long. However, the depth of the product portions 56 may vary between 0.20 inches and 0.25 inches depending upon whether or not ninety product portions 56 per pound are desired or seventy-two product portions 56 per pound are desired, respectively. The length of the substrate as cut for each of the product portions 56 will be approximately 2.356 inches. To change the number of portions per pound, the extruder 26 would have to be changed to vary the thickness from 0.20 inches to 0.25 inches. All that is being changed is the thickness of the product portion 56.

An alternative method may be used to crease the bottom substrate 28 by replacing floating bar 40 and weight and stop bar 42 with an upper roller (not shown). If two mating rollers are used to form the crease in the bottom substrate 28, it would be desirable to have a first set of rollers (not shown) that forms a 45° crease in the bottom substrate at both the lower and upper portions of the channel being formed and a second set of rollers (not shown) that completes the approximately 90° crease to form the final channel 58. By use of pneumatic pressure to control one roller of each set of rollers, two sets of rollers could be used in creasing the bottom substrate 28 instead of the floating bar 40 and weight and stop bar 42.

The types of bottom substrate 28 and upper substrate 64 may vary. Generally a grease proof type of imitation parchment paper is used. However, parchment paper or a metalized paper can also be used, as well as a foil. A laminate foil and parchment paper are also suitable substrates. The thickness or weight of the particular substrate 28 or 64 being used is not particularly critical, as long as the substrate will hold a crease until the adhesive bonds the substrates 28 and 64 together. The thinner the substrate, normally the more economical the substrate for use. The particular type substrate is not the critical.

I claim:

1. An apparatus for extruding and wrapping portions of a pliable product of individually wrapped portions being placed in trays, said apparatus comprising:

a housing;

means for receiving said pliable product within said housing;

drive means mounted on said housing;

means for dispensing said upper and lower substrates from pivotally mounted rolls on said housing;

means for pumping said pliable product from said receiving means through an extruder to product cutter means for cutting the extruder pliable product into portions, said pumping means and said product cutter means being driven by said drive means;

channel forming means to form a channel in said lower substrate as received from said dispensing means;

draw means for drawing said upper and lower substrates together to adhere around said portions after said portions are dropped in said channel, depth of said channel being approximately same depth as said portions;

substrate cutting means for simultaneously cutting and pressing together said upper and lower substrates between said portions of said pliable product to form said individually wrapped portions;

tension means for separating said individually wrapped portions after said cutting and for depositing said individually wrapped portions in said trays;

tray advancement means for carrying said trays thereon to receive deposits of said individally wrapped portions, said tray advancement means being driven by drive means to advance as said deposits are made in a first of said trays;

means for rapidly moving said tray advancement means forward a specific amount as said deposits fill said first tray with said predetermined number of said individually wrapped portions and said deposits are started in a second of said trays, said rapid movement of said tray advancement means being repeated as said trays are filled; and said drive means driving said draw means, substrate cutting means, tension means, tray advancement means, and said rapid movement means.

2. The apparatus as recited in Claim 1 wherein said tray advancement means includes chain means with carriage means thereon for carrying said trays, said means for rapidly moving including gear means for rapid rotation of cam means, said cam means striking cam follower means to provide rapid movement of said chain means and carriage means about clutch means.

3. The apparatus as recited in claim 2 further including chute means contiguous with said chain means for maintaining said trays on said carriage means.

4. The apparatus as recited in claim 3 including finger means for removing said trays from said carriage means after filling of said trays and angle chute for directing said trays onto conveyor means.

5. The apparatus as recited in claim 4 including means for positioning said trays on said carriage means, said chain means and said carriage means being pivotal during non-use for maintenance.

6. The apparatus as recited in claim 1 includes applicator means for applying a hot melt adhesive to either said upper or lower substrate for adhering said substrates around said portions.

7. The apparatus as recited in claim 6 wherein said substrate cutter means includes anvils on each side of cutting blades, said anvils tucking each end of said individually wrapped portions.

8. The apparatus as recited in claim 1 wherein said channel forming means includes at least one channeled roller receiving said lower substrate thereacross, plate means riding on said lower substrate to force said lower substrate into a channel of said channeled roller and thereby crease said lower substrate into a channel shape with flanges on either sides thereof.

9. The apparatus as recited in claim 1 wherein said channel forming means includes first mating rollers with said lower substrate being drawn therebetween, said first mating rollers having a channel in a lower of said first mating rollers and a matching ridge in an upper of said first mating rollers to thereby crease said lower substrate into a channel shape with flanges on either side thereof as said lower substrate is being drawn therebetween.

10. A method of individually wrapping portions of a pliable product between upper and lower substrates and packaging a predetermined number of individually wrapped portions in trays, said method consisting of the following steps:

providing a product receiving means to receive said pliable product;

providing a pivotally mounted a roll of said upper and a roll of said lower substrate on a housing;

forming a channel in said lower substrate by channel forming means as said lower substrate is received from said lower roll;

pumping said pliable product from said receiving means to an extruder by a pump driven by motor means;

extruding said pliable product from said extruder;

first cutting said extruded pliable product into portions by portion cutter means;

dropping said portions in said channel of said lower substrate;

drawing said upper substrate and said lower substrates together for adhering with said portions therebetween in said channel;

second cutting and pressing said upper and lower substrates between said portions by substrate cutter means to form said individually wrapped portions;

separating said individually wrapped portions by tension means and depositing said individually wrapped portions means and depositing said indivudally wrapped portions in a first of said trays;

advancing said trays by tray carrying means as said first of said trays is filled to said predetermined number;

rapidly advancing said tray and said tray carrying means by rapid advancing means when said first of said trays is filled to said predetermined number to fill a second of said trays with said individually wrapped portions;

repeating said rapid advancing as each of said trays is filled with said predetermined number of said individually wrapped portions; and timing all moving parts of aforesaid steps with said motor means.

11. The method of claim 10 including before said drawing step including a step of applying a hot melt adhesive to either said upper substrate or said lower substrate by a hot melt applicator for said adhering of said upper substrate and said lower substrate together.

12. The method of claim 11 includes a step of guiding said trays on tray carrying means by chute means.

13. The method of claim 12 includes a step of removing said trays after said trays are filled, said removing step includes finger means for removing and curved chute for redirecting said trays onto conveyor means.

14. The method of Claim 10 wherein said rapid advancing step includes rapid driving of cam means to strike a cam follower of said tray carrying means to rapidly move said tray carrying means and trays thereon about clutch means.

15. The method of claim 14 includes a step of pivoting said tray carrying means away from said tension means during no-operation for maintenance.

16. The method of claim 11 wherein said forming step includes pressing said lower substrate between two mating rollers to form said channel in said lower substrate.

17. The method of claim 11 wherein said forming step includes pressing said lower substrate into a channeled roller by plate means to form said channel in said lower substrate.

18. The method of claims 10, 11, or 14 wherein said second cutting step includes tucking each end of said individually wrapped portions by an anvil on each side of a cutting blade of said substrate cutting means.

* * * * *